US010232652B2

(12) United States Patent
Campillo et al.

(10) Patent No.: US 10,232,652 B2
(45) **Date of Patent: *Mar. 19, 2019**

(54) METHOD OF MAINTAINING PRINTHEADS USING WIPERS MOVING IN OPPOSITE DIRECTIONS

(71) Applicant: MEMJET TECHNOLOGY LIMITED, Dublin (IE)

(72) Inventors: Alejandro Campillo, San Diego, CA (US); Rajan Ramaswamy, San Diego, CA (US); Tinh Tran, San Diego, CA (US); David Lovelace, San Diego, CA (US)

(73) Assignee: Memjet Technology Limited (IE)

( * ) Notice: Subject to any disclaimer, the term of this patent is extended or adjusted under 35 U.S.C. 154(b) by 0 days.

This patent is subject to a terminal disclaimer.

(21) Appl. No.: 15/625,804

(22) Filed: Jun. 16, 2017

(65) Prior Publication Data

US 2017/0282567 A1 Oct. 5, 2017

Related U.S. Application Data

(63) Continuation of application No. 15/015,025, filed on Feb. 3, 2016, now Pat. No. 9,925,780, which is a continuation of application No. 14/712,742, filed on May 14, 2015, now Pat. No. 9,283,764, which is a continuation of application No. 14/473,806, filed on Aug. 29, 2014, now Pat. No. 9,061,531.

(60) Provisional application No. 61/904,983, filed on Nov. 15, 2013.

(51) Int. Cl.

| | |
|---|---|
| ***B41J 2/165*** | (2006.01) |
| ***B41J 2/175*** | (2006.01) |
| ***B41J 25/304*** | (2006.01) |
| ***B41J 25/34*** | (2006.01) |
| ***B41J 25/00*** | (2006.01) |

(52) U.S. Cl.

CPC ..... *B41J 25/304* (2013.01); *B41J 2/16505* (2013.01); *B41J 2/16535* (2013.01); *B41J 2/16585* (2013.01); *B41J 25/001* (2013.01); *B41J 25/34* (2013.01); *B41J 2202/20* (2013.01)

(58) Field of Classification Search

CPC ..... B41J 2/1754; B41J 2/165; B41J 2/16505; B41J 2/16511; B41J 2/16547; B41J 2/16585

See application file for complete search history.

(56) References Cited

U.S. PATENT DOCUMENTS

| | | | | |
|---|---|---|---|---|
| 9,061,531 | B2 * | 6/2015 | Campillo | B41J 2/16505 |
| 9,283,764 | B2 * | 3/2016 | Campillo | B41J 2/16505 |
| 2002/0027579 | A1 * | 3/2002 | Matsuo | B41J 2/14233 347/68 |
| 2002/0051025 | A1 * | 5/2002 | Hinojosa | B41J 2/01 347/16 |
| 2009/0122126 | A1 * | 5/2009 | Ray | B41J 11/002 347/102 |

(Continued)

*Primary Examiner* — Jason S Uhlenhake
(74) *Attorney, Agent, or Firm* — Cooley LLP

(57) ABSTRACT

A method of wiping a plurality of printheads positioned in a staggered overlapping arrangement across a width of a media feed path, each printhead having a respective wiper associated therewith. The wipers for neighboring printheads are moved in opposite directions with respect to each other.

10 Claims, 18 Drawing Sheets

(56) References Cited

U.S. PATENT DOCUMENTS

2009/0189946 A1* 7/2009 Taira ..... B41J 2/16526
347/33

* cited by examiner

METHOD OF MAINTAINING PRINTHEADS USING WIPERS MOVING IN OPPOSITE DIRECTIONS

CROSS-REFERENCE TO RELATED APPLICATIONS

This application is a continuation of U.S. application Ser. No. 15/015,025, filed Feb. 3, 2016, entitled METHOD OF MAINTAINING PRINTHEADS USING WIPERS MOVING IN OPPOSITE DIRECTIONS, which is a continuation of U.S. application Ser. No. 14/712,742 filed on May 14, 2015, now issued U.S. Pat. No. 9,283,764, which is a continuation of U.S. application Ser. No. 14/473,806 filed on Aug. 29, 2014, now issued U.S. Pat. No. 9,061,531, which claims priority to U.S. Provisional Application No. 61/904,983, filed Nov. 15, 2013, the contents of each of which are incorporated by reference herein for all purposes.

This application is related to U.S. application Ser. No. 14/473,811, filed Aug. 29, 2014, now issued U.S. Pat. No. 9,242,493, and to U.S. application Ser. No. 14/473,814, filed Aug. 29, 2014, now issued U.S. Pat. No. 9,193,194, the contents of each of which are incorporated by reference herein for all purposes.

FIELD OF THE INVENTION

This invention relates to a printer module and high-speed printers comprising one or more of such printer module(s). It has been developed for printing onto media webs, and particularly for use in conjunction with existing web feed mechanisms, such as those installed in offset printing presses.

BACKGROUND OF THE INVENTION

Inkjet printing is well suited to the SOHO (small office, home office) printer market. Increasingly, inkjet printing is expanding into other markets, such as label and wideformat printing. High-speed web printing is becoming a significant commercial sector for the inkjet printing market. High-speed inkjet web printing is especially competitive with traditional offset printing presses over relatively short print runs, because digital printing does not require the initial set-up time and cost of preparing offset printing plates. In a digital inkjet web printer, it is possible to print, for example, thousands of labels on-demand.

Hitherto, the present Assignee has described a number of inkjet web printers employing Memjet® pagewidth printing technology. Memjet® pagewidth printers employ one or more fixed printhead(s) while print media, such as a media web, are fed continuously past the printhead(s). This arrangement vastly increases print speeds compared to traditional scanning printhead technologies.

US 2011/0279530 (the contents of which are herein incorporated by reference) describes a benchtop web printer suitable for printing labels. The benchtop printer includes a single multi-color pagewidth printhead, an integrated web feed mechanism and a maintenance station. The maintenance station comprises individual liftable modules which cross the media feed path in order to perform printhead maintenance. A disadvantage of this arrangement is that a media web must be broken in order to perform printhead maintenance. This maintenance regime therefore places limitations on the types and lengths of print jobs that may be performed.

US 2012/0092419 (the contents of which are herein incorporated by reference) describes an industrial web printer comprised of a plurality of monochrome pagewidth printheads aligned with each other in a media feed direction. The printheads are mounted on a common housing connected to a scissor lift mechanism. The scissor lift mechanism enables the printheads to be lifted and lowered relative to the media web. In order to perform printhead maintenance, the printheads are lifted, a maintenance assembly is slid laterally underneath the printheads and the printheads lowered onto the maintenance assembly. In this way, printhead maintenance may be performed without breaking the media web. However, a disadvantage of the printer described in US 2012/0092419 is its relatively high cost as well as difficulties in scaling the printer for printing onto wider media widths.

U.S. Pat. No. 8,485,656 (the contents of which are herein incorporated by reference) describes a wide format printer comprising a plurality of staggered overlapping printheads. Each printhead is maintained by a respective rotatable maintenance carousel positioned opposite its respective printhead. Each carousel crosses the media path in order to perform printhead maintenance, which necessitates breaking the media web.

It would be desirable to provide a relatively low-cost, high-speed inkjet web printer, which does not require breaking the media web in order to perform printhead maintenance. It would further be desirable to provide an inkjet web printer, which is readily scalable to wider media widths (e.g. widths greater than about 210 mm). It would further be desirable to provide a high-speed inkjet web printer, which is amenable to retrofitting into existing web feed arrangements, such as those used in offset printing presses. Such a retrofitted printer is an attractive proposition for commercial printing presses having a number of offset printing lines and, moreover, promotes uptake of digital web printing at a relatively low cost.

SUMMARY OF THE INVENTION

In a first aspect, there is provided a modular printer comprising:

(a) a media feed path defining a media feed direction;

(b) a first printer module suspended over the media feed path, the first printer module comprising:

a first printhead extending transversely with respect to the media feed direction;

a first maintenance sled positioned at a first side of the first printhead relative to the media feed direction, the first maintenance sled being slidable towards the first printhead parallel with the media feed direction;

(c) a second printer module suspended over the media feed path and at least partially overlapping the first printer module in the media feed direction, the second printer module comprising:

a second printhead extending transversely with respect to the media feed direction, the second printhead at least partially overlapping the first printhead in the media feed direction; and a second maintenance sled positioned at an opposite second side of the second printhead relative to the media feed direction, the second maintenance sled being slidable toward the second printhead parallel with the media feed direction, wherein the first and second printheads are relatively proximal to each other with respect to the media feed direction, and the first and second maintenance assemblies are relatively distal from each other with respect to the media feed direction.

As used herein, the term "printhead" generally refers to a non-traversing printhead which is stationary during printing, as opposed to conventional scanning printheads which traverse across the media path printing in swathes.

The modular printer according to the first aspect advantageously enables printing onto relatively wide media webs using a readily scalable arrangement of first and second printer modules. In principle, the range of printable media widths is virtually limitless, simply by placing the first and second printer modules in an alternating overlapping arrangement across the media feed path.

In this modular arrangement, the width of the print zone is minimized by placing the printheads relatively proximal and the maintenance stations relatively distal. This arrangement maximizes print quality whilst enabling a versatile maintenance regime. Typically, a distance between the first and second printheads in the media feed direction is from 10 to 200 mm or from 20 to 100 mm. Correspondingly, the width of the print zone is in the range of 10 to 200 mm or 20 to 100 mm. The width of the print zone is defined in a direction parallel to the media feed direction.

Preferably, the first and second maintenance assemblies are configured to move in opposite directions—that is, towards each other and towards respective first and second printheads. In other words, the first maintenance sled may move in the same direction as the media feed direction, while the second maintenance sled moves in the opposite direction. Alternatively, the first maintenance sled may move in an opposite direction to the media feed direction, while the second maintenance sled moves in the same direction as the media feed direction.

Preferably, the first and second printheads are each mounted in a respective printhead cartridge, which may be user-replaceable. The printhead cartridge may comprise, for example, ink couplings and an ink feed arrangement in addition to the printhead. The printheads may be multi-color printheads or monochrome printheads.

Preferably, the printhead cartridges are identical and replaceable in each of the first and second printer modules. Providing identical, replaceable printhead cartridges in the first and second printer modules minimizes printhead cartridge production costs and is convenient for end-users.

The first and second printer modules may be the same or different from each other. Identical first and second printer modules have the advantage of reducing production costs of the printer modules. However, identical first and second printer modules require the same relative orientation of the printhead cartridge and the maintenance station. Since printheads typically have asymmetrical color planes with respect to the media feed direction, identical first and second printer modules require printhead cartridges in the first printer module to print "forwards" (e.g. CMYK) and printhead cartridges in the second printer modules to print "backwards" (e.g. KYMC). Although such a configuration is technically possible using appropriate controller firmware, in practice it is difficult to ensure consistent print quality across the media width when some printheads are printing "forwards" and some printheads are printing "backwards". For example, the different effects of overprinting and underprinting are difficult to compensate when the color plane order is reversed.

Therefore, the printhead cartridges are preferably all oriented identically with respect to the media feed direction, such that all printheads print with the same color plane sequence. The corollary is that the first and second printer modules are preferably non-identical by virtue of the different orientations of the printheads relative to the maintenance assemblies in the first and second printer modules.

Preferably, the first and second printer modules comprise respective lift mechanisms for lifting a respective printhead cartridge relative to the media feed path. Lifting the printhead cartridges relative to the media feed path enables the printheads to be maintained without breaking the media web.

Preferably, the first and second printer modules each comprise a respective print bar carriage, the print bar carriage being slidably received within the housing and liftable relative to the housing.

Preferably, each print bar carriage carries a respective printhead cartridge.

Preferably, each print bar carriage carries a respective ink manifold, the ink manifold having at least one coupling for mating with and supplying ink to a respective printhead cartridge.

Preferably, in the first aspect, the print zone has a length greater than 216 mm and up to about 2000 mm, the length of the print zone being defined in a direction transverse to the media feed direction. In some embodiments, the print zone has a length greater than 300 mm, greater than 400 mm or greater than 500 mm. Hence, the modular printer is capable of printing onto wideformat media—that is media wider than standard A4 or US letter-sized media.

The first and second printer modules may be fixedly mounted to, for example, a gantry suspended over the media feed path. Typically, the first and second printer modules comprise rigid mounting beams configured for mounting the printer modules over the media feed path.

In a second aspect, there is provided a printer assembly comprising:

a housing comprising a pair of opposite sidewalls, each sidewall defining a respective referencing slot;

a pair of first stops, each first stop being positioned towards a lower end of a respective referencing slot defined in a respective sidewall of the housing, each first stop defining a first datum surface;

a print bar carriage slidably received within the housing, the print bar carriage comprising:

a chassis;

a printhead supported by the chassis; and a pair of lugs, each lug extending outwardly from opposite sides of the chassis, each lug being received in a respective referencing slot of the housing, and each lug being slidably movable within its respective referencing slot; and a lift mechanism for lifting the print bar carriage relative to the housing, wherein the first datum surfaces define a printing position of the print bar carriage, the print bar carriage being in the printing position when each lug is in abutting engagement with its respective first datum surface.

The printer assembly according to the second aspect advantageously enables the printing position of the liftable print bar carriage to be defined with reference to a housing in which the print bar carriage is slidably received. In particular, the lugs, referencing slots and stops provide a compact design without any special modifications required to the printhead. Each of the printer modules described in connection with the first aspect may comprise a printer assembly according to the second aspect.

Typically, the stops have adjustable heights enabling facile user adjustment of the printing position height (e.g. for use with different media thicknesses) without requiring internal access to each printer assembly. Once the printer assembly has been installed by suspending over a media feed path (e.g. by mounting to a rigid overhead cantilever beam or gantry), the stops may then be used to control the height of the printing position relative to the media and, hence, the "pen-to-paper spacing" (PPS) or "throw distance" of ejected ink droplets.

Preferably, the printhead is mounted between opposite side panels of the chassis and each lug extends outwardly from a respective side panel.

Preferably, each first stop is mounted to an outer (external) surface of a respective sidewall of the housing. Externally mounted stops avoid any interference between the datum referencing for the printhead and a sliding maintenance sled for maintaining the printhead. Furthermore, externally mounted stops facilitate user accessibility in situ when the printer assembly is installed.

Preferably, each first stop is adjustably mounted relative to its respective sidewall to provide a plurality of different printing positions. Suitable means for providing adjustable mounting of each first stop will be readily apparent to the person skilled in the art. For example, a slider mechanism or a screw mechanism may be used for manual stop height adjustment. Alternatively, a range of predetermined stop heights may be provided using one or more detents in combination with a slider mechanism, as is known in the art.

Preferably, the housing comprises one or more upper mounting plates or beams for fixedly mounting the printer assembly on a support, so as to suspend the printer assembly over a media path.

Preferably, the lift mechanism comprises a rack and pinion mechanism.

Preferably, the carriage comprises a pair of racks and a shaft is rotatably mounted between the sidewalls of the housing, wherein a pair of pinions are fixedly mounted about the shaft, each pinion being engaged with a respective rack.

Preferably, the housing defines a guide slot engaged with part of the carriage, said guide slot constraining movement of the carriage relative to the housing.

Preferably, the guide slot is laterally spaced from one of the referencing slots and extends parallel therewith.

Preferably, a first sidewall of the housing has a respective guide slot and the carriage comprises a plurality of rotatably mounted first bearings, each first bearing travelling within the guide slot.

Preferably, the plurality of first bearings are rotatably mounted to a bracket fixed to a side panel of the chassis.

Preferably, the first bearings are aligned with each other and parallel with the racks.

Preferably, the printer assembly further comprises:

- a track fixed to the housing, the track extending transversely with respect to the referencing slots;
- a maintenance sled mounted on the track;
- a transport mechanism for transporting the maintenance sled along the track; and
- a controller for coordinating the lift mechanism and the transport mechanism, the controller being configured to provide:
  - the printing position in which the maintenance sled is laterally displaced out of alignment with the printhead; and
  - a maintenance position in which at least part of the maintenance sled is aligned with the printhead, wherein the printhead is raised in the maintenance position relative to the printing position.

The printer assembly may be configured into the maintenance position (e.g. a capping position of a wiping position) by lifting the print bar using the lift mechanism, transporting the maintenance sled parallel with the media feed direction towards the printhead, and lowering the print bar such that the printhead is engaged with a suitable maintenance module (e.g. capper or wiper). The printer assembly may be configured into the printing position by lifting the print bar using the lift mechanism, transporting the maintenance sled away from the printhead, and lowering the print bar such that the printhead is in the printing position, the printing position being lower than the maintenance position.

Preferably, the maintenance sled comprises at least one of:

- a capper module for capping the printhead; and
- a wiper module for wiping the printhead.

Preferably, the capper module comprises a pair of second stops disposed at either end of a perimeter capper, each second stop defining a second datum surface.

Preferably, landing zones are defined at either longitudinal end of the printhead for abutting engagement with the second datum surfaces in a capping position.

As described in US 2011/0279524, the contents of which are herein incorporated by reference, the perimeter capper may comprise an internal wick element positioned for capturing ink during spitting and/or priming operations. The wick element is placed accurately in close proximity with (but not in contact with) the printhead, such that a fluidic bridge ("ink bridge") can form between the printhead and the wicking element. Accordingly, the second datum surfaces and landing zones are employed for accurate positioning of the perimeter capper, which is preferably of the type described in US 2011/0279524.

Preferably, the wiper module is resiliently mounted on the maintenance sled. Resilient mounting of the wiper module allows a degree of tolerance in the positioning of the printhead relative to the wiper in a wiping position. Typically, the wiping position is less critical than the capping position and may be controlled using suitable sensors and/or timers on the lift mechanism, rather than via datums.

Preferably, the wiper module comprises a rotatably mounted wiper roller, the wiper roller being coextensive with the printhead. A suitable maintenance sled comprising a wiper roller and perimeter capper, which may be adapted for use in connection with the present printer assembly, is described in US 2012/0092419, the contents of which are incorporated herein by reference.

In a third aspect, there is provided a printer assembly comprising:

a housing comprising a pair of opposite first and second sidewalls extending along a nominal x-axis, the first sidewall having a guide slot extending along a z-axis, the guide slot being defined between opposite first bearing surfaces;

a shaft rotatably mounted between the sidewalls, the shaft extending along a y-axis;

first and second pinions fixedly mounted at either end of the shaft for rotation therewith;

a print bar carriage slidably received within the housing, the print bar carriage comprising:

- a chassis;
- first and second parallel racks fixed to the chassis, each rack being engaged with a respective pinion to define a rack-and-pinion lift mechanism;
- a set of first bearings rotatably mounted at a first side of the chassis, each first bearing being received in the guide slot; and
- a printhead supported by the chassis; and a drive motor operatively connected to the shaft for rotating the shaft and thereby lifting the print bar carriage relative to the housing along the z-axis via the rack-and-pinion lift mechanism, wherein, during sliding movement of the print bar carriage, the set of first bearings travels within the guide slot and bear against the first guide surfaces to constrain rotational movement of the print bar carriage.

The printer assembly according to the third aspect advantageously provides a rigid framework for raising and lowering the print bar carriage with highly accurate positioning. In particular, cooperation of the first bearings with the guide slot of the rigid housing provides excellent constraint of undesirable printhead rotation. Each of the first and second printer modules described in connection with the first aspect may comprise a printer assembly according to the third aspect.

Raising and lowering a print bar introduces significant rotational forces due to the intrinsic moment of the print bar about the lift axis. By way of contrast, U.S. Pat. No. 8,353,566 describes a rack-and-pinion lift mechanism whereby a pair of brackets are slidably mounted on a complementary pair of guide posts. Each bracket has a rack connected to a print bar enabling the print bar to be raised and lowered via rotation of a shaft having a pair of pinions engaged with the racks. A disadvantage of the lift mechanism described in U.S. Pat. No. 8,353,566 is that the elongate guide posts inevitably lack true parallelism, which is problematic for printhead positioning as well as operation of the lift mechanism. U.S. Pat. No. 8,353,566 attempts to address this problem by allowing a degree of play in the bracket mountings and relying solely on datums in the lowered position for correcting misalignments in theta y during lifting/lowering. However, the prior art arrangement inevitably results in undue wearing of the lift mechanism and, moreover, does not ensure accurate positioning of the printhead in the printing position. The printer assembly according to the third aspect ensures smooth lifting and lowering of the printhead with minimal wear and accurate printhead placement in the printing position.

Preferably, the carriage comprises a second bearing rotatably mounted to an inner surface of the second sidewall, wherein the second bearing bears against a second bearing surface of the print bar carriage, said second bearing surface extending along the z-axis. The first and second bearings, therefore, cooperate to constrain rotational movement of the print bar carriage in theta z as well as theta y.

Preferably, the second bearing surface is defined by a non-toothed surface of the second rack. Typically, the non-toothed surface is opposite a toothed surface of the second rack, the toothed surface being intermeshed with the second pinion.

Preferably, the shaft and pinions cooperate with the parallel racks to constrain rotational movement of the print bar about the x-axis. Thus, the print bar carriage is preferably constrained in theta x, theta y and theta z during lifting and lowering.

Preferably, the chassis comprises first and second opposite side panels, the set of first bearings being rotatably mounted to a bracket fixed to the first side panel of the chassis.

Preferably, the housing comprises a track extending transversely with respect to the referencing slots, wherein the printer assembly further comprises:

a maintenance sled mounted on the track;

a transport mechanism for transporting the maintenance sled along the track; and a controller for coordinating the lift mechanism and the transport mechanism, the controller being configured to provide:

the printing position in which the maintenance sled is laterally displaced out of alignment with the printhead; and a maintenance position in which at least part of the maintenance sled is aligned with the printhead, wherein the printhead is raised in the maintenance position relative to the printing position.

Preferably, the transport mechanism comprises an endless drive belt tensioned about a plurality of pulleys, the maintenance sled being attached to the drive belt for movement therewith.

Preferably, the bracket is configured to avoid contact with the drive belt in the printing position. Preferably, the bracket is L-shaped or U-shaped.

Preferably, each sidewall of the housing comprises a pair of first stops, each first stop defining a first datum surface, each first stop being positioned towards a lower end of a respective referencing slot defined in each sidewall, each referencing slot being laterally spaced from and parallel with the guide slot; and the print bar carriage comprises a pair of lugs, each lug extending outwardly from opposite sides of the chassis, each lug being received in a respective referencing slot of the housing, and each lug being slidably movable within its respective referencing slot, wherein the first datum surfaces define a printing position of the print bar carriage, the print bar carriage being in the printing position when each lug is in abutting engagement with its respective first datum surface.

Preferably, the print bar carriage comprises a chassis having opposite side panels, the printhead being mounted between the side panels, and wherein each lug extends outwardly from a respective side panel.

Preferably, each first stop is mounted to an outer surface of a respective sidewall of the housing.

Preferably, each first stop is adjustably mounted relative to its respective sidewall to provide a plurality of different printing positions.

Preferably, the maintenance sled comprises at least one of: a capper module for capping the printhead; and a wiper module for wiping the printhead.

Preferably, the capper module comprises a pair of second stops disposed at either end of a perimeter capper, each second stop defining a second datum surface.

Preferably, landing zones are defined at either longitudinal end of the printhead for abutting engagement with the second datum surfaces in a capping position.

Preferably, the wiper module is resiliently mounted on the maintenance sled.

Preferably, the wiper module comprises a rotatably mounted wiper roller, the wiper roller being coextensive with the printhead.

It will be appreciated that preferred and other embodiments described herein may be applicable to any one or more of the first, second and third aspects.

BRIEF DESCRIPTION OF THE DRAWINGS

Embodiments of the present invention will now be described by way of example only with reference to the accompanying drawings, in which.

DETAILED DESCRIPTION OF THE INVENTION

Printer Module Overview

Figure 1:
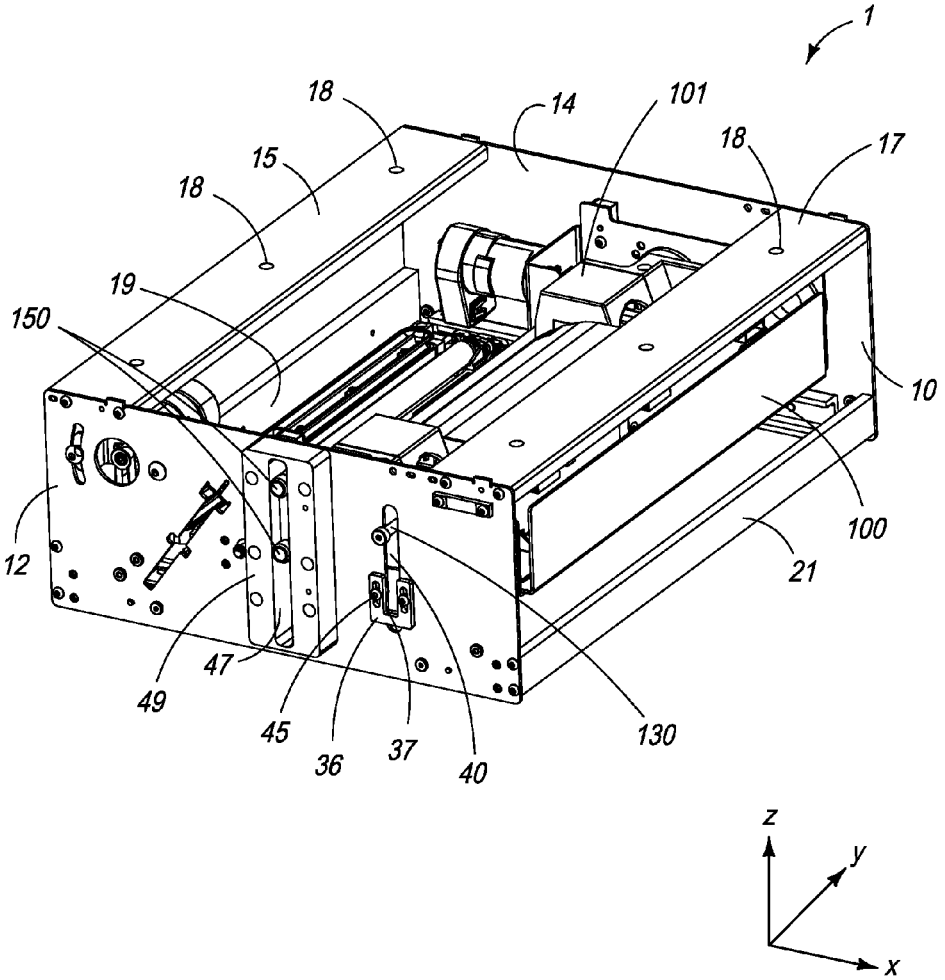
FIG. 1 is a perspective of a printer module according to the present invention.

Referring to FIG. 1, there is shown a printer assembly in the form of a printer module 1 comprising a housing 10 having a first sidewall 12 and an opposite second sidewall 14. The first and second sidewalls 12 and 14 are connected via upper mounting beams 15 and 17, and lower connecting beams 19 and 21 to provide a rigid framework for housing a print engine comprised of a print bar carriage 100 and maintenance sled 200 (see FIG. 5). Each of the mounting beams 15 and 17 has mounting fixtures 18 for mounting the printer module 1 to a gantry or cantilever beam (not shown). Thus, the printer module 1 is configured for suspending over a print media path. Print media, such as a media web, may be fed past the printer module 1 using, for example, suitable feed rollers as is known in the art. The housing 10 has no base to facilitate feeding of the media web past a lower portion of the printer module 1.

Figure 2:
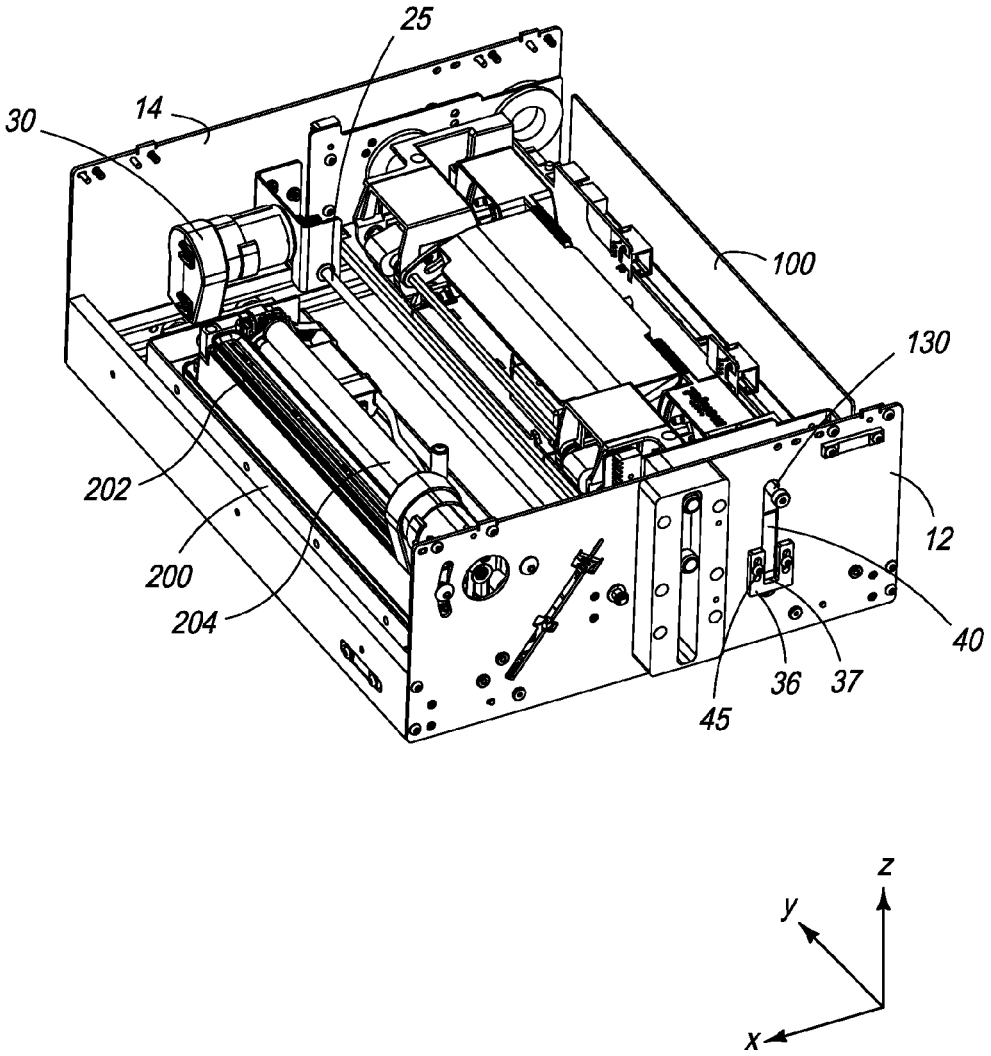
FIG. 2 is a perspective of the printer module with mounting beams removed.

The print bar carriage 100 is slidably received within the housing 10 enabling lifting and lowering of the print bar carriage relative to the housing 10 using a lift mechanism. As shown in FIGS. 1 and 2, the print bar carriage 100 is raised in a transition position; as shown in FIG. 3, the print bar carriage 100 is lowered in a printing position; and as shown in FIG. 4, the print bar carriage 100 is raised in a maintenance position.

Figure 6:
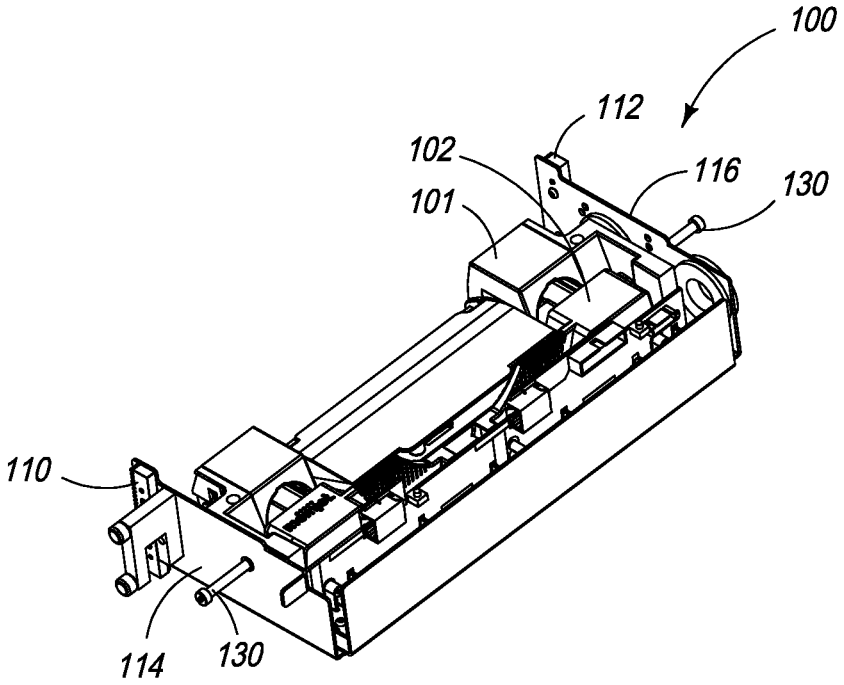
FIG. 6 is a perspective of a print bar carriage.
Figure 7:
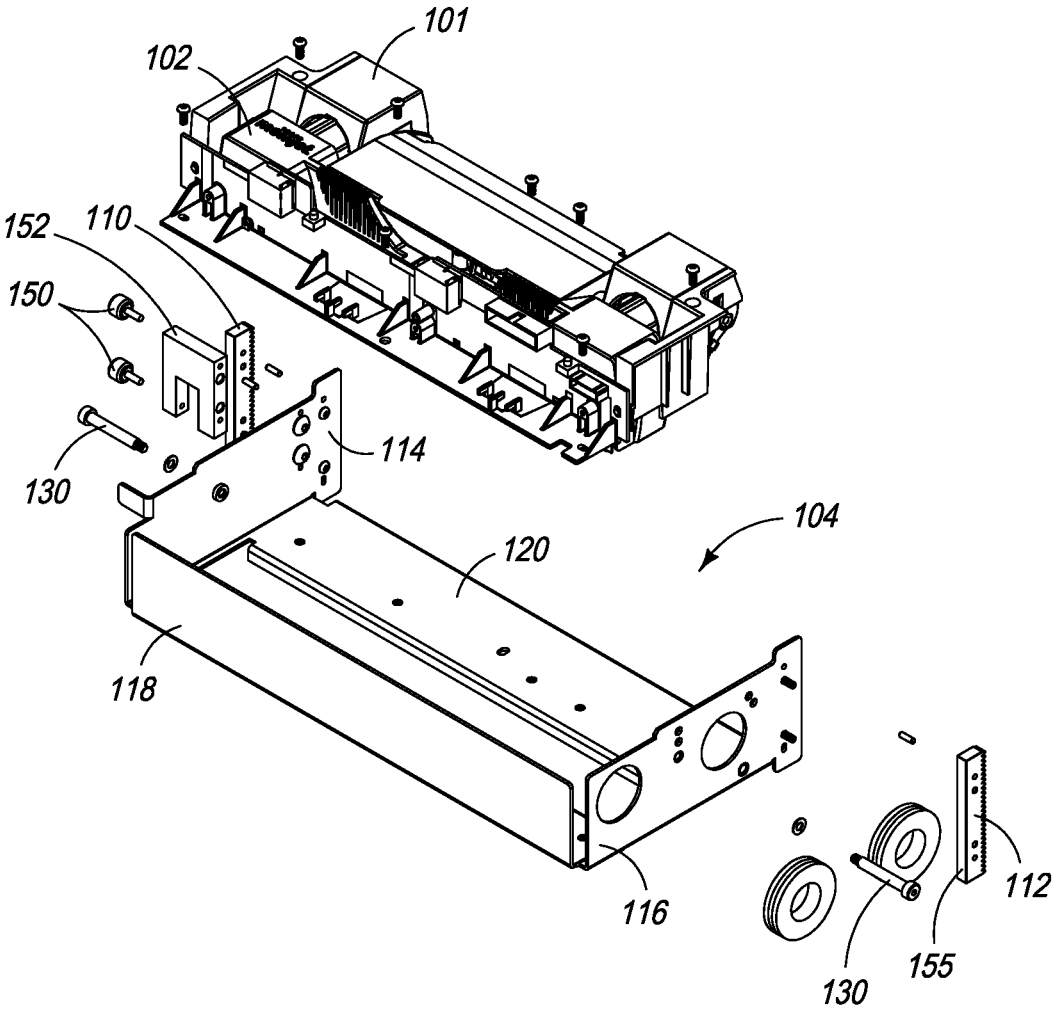
FIG. 7 is an exploded perspective of the print bar carriage.

Referring briefly to FIGS. 6 and 7, the print bar carriage 100 comprises an ink manifold 101 and printhead cartridge 102, such as a replaceable Memjet® printhead cartridge, mounted on a chassis 104 for printing onto print media in a single pass. (For a detailed description of the printhead cartridge 102, reference is made to U.S. Pat. Nos. 8,540,353; 8,025,383 and 7,845,778, the contents of which are incorporated herein by reference). The ink manifold 101 is configured for supplying ink to and receiving ink from the printhead cartridge 102 via a pair of couplings, such as the couplings described in U.S. Pat. No. 8,540,353, the contents of which are herein incorporated by reference. The ink manifold 101 forms part of an ink delivery system (not shown) in fluid communication with the printhead 105. The printhead cartridge 102 comprises a printhead 105 mounted to a lower surface thereof (FIG. 14), which requires periodic maintenance. Maintenance may be required to wipe nozzles free of ink and debris, to unblock nozzles which have become blocked with ink or to minimize evaporation of ink by capping the printhead 105.

Figure 3:
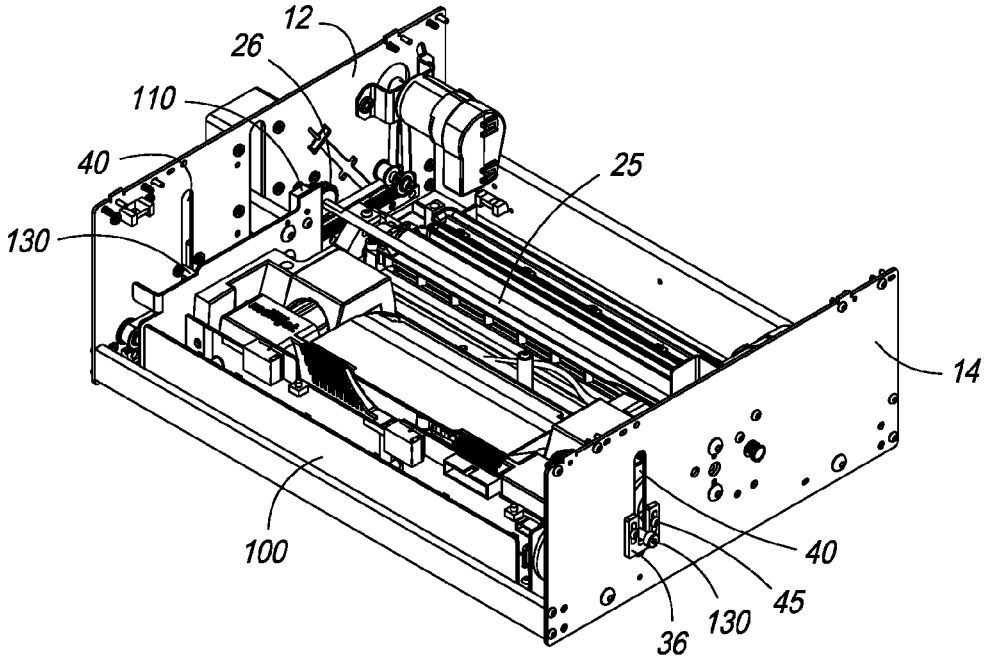
FIG. 3 is a perspective of the printer module configured in a printing position with mounting beams removed.
Figure 4:
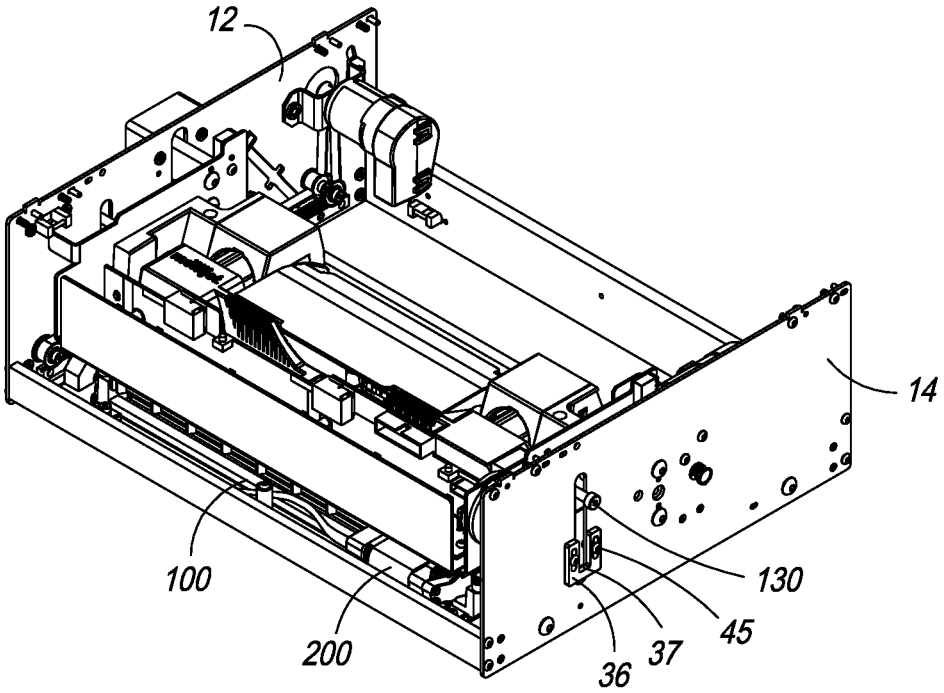
FIG. 4 is a perspective of the printer module configured in a maintenance position with mounting beams removed.

Referring to FIGS. 2 to 4, the maintenance sled 200 is slidable along a nominal x-axis of the printer module 1 using a transport mechanism (described below), the x-axis being defined as an axis parallel to a media feed direction. Maintenance modules in the form of a capper module 202 and a wiper module 204 are mounted on the maintenance sled 200 for performing respective capping and wiping operations on the printhead.

In order to perform a capping or wiping operation, the print bar carriage 100 is raised to its transition position (FIGS. 1 and 2), the maintenance sled is moved along the x-axis so as to be positioned below the printhead 105, and the print bar carriage lowered onto either the capper module 202 or the wiper module 204 (FIG. 4). Of course, the precise positioning of the maintenance sled 200 relative to the printhead 105 will depend on whether a capping or wiping operation is being performed. Generally, the printhead 105 is maintained in a capped state during idle periods.

In order to perform printing, the print bar carriage 100 is raised to its transition position and the maintenance sled 200 is laterally displaced to one side of the printhead 105 by slidably moving the maintenance sled along the x-axis (FIGS. 1 and 2). Once the maintenance sled 200 has been laterally displaced from the printhead 105, the print bar carriage 100 is lowered to a printing position (FIG. 3), which is the lowest position of the print bar carriage.

Figure 8:
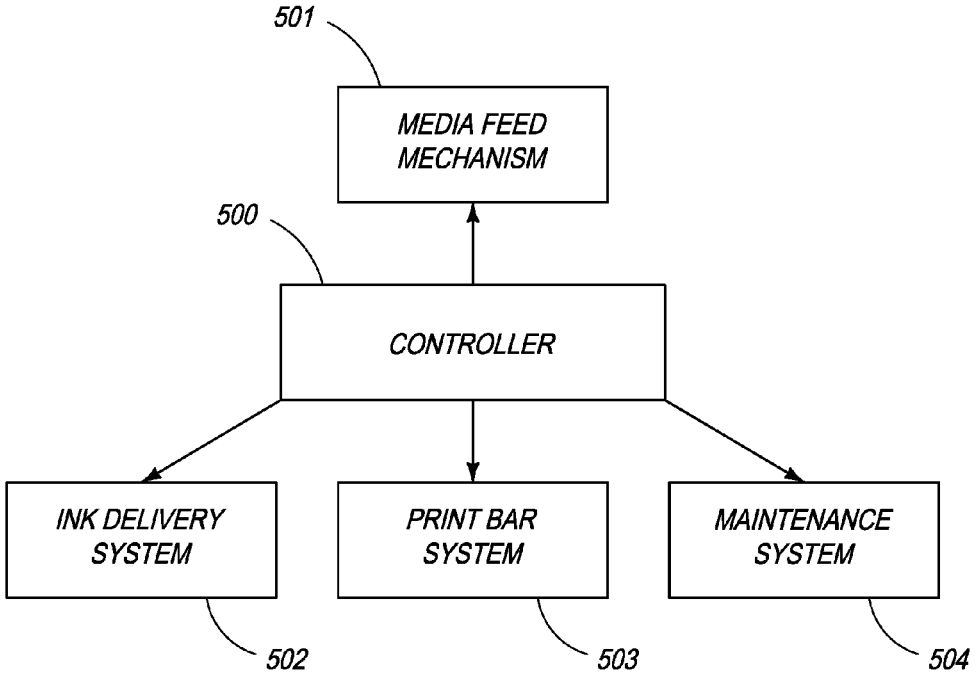
FIG. 8 is schematic system control block diagram.

Referring to FIG. 8, a controller 500 is employed to coordinate various operations of a media feed mechanism 501; an ink delivery system 502 which delivers ink to the printhead; a print bar system 503 comprising the print bar carriage 100, printhead 105 and lift mechanism; and a maintenance system 504 comprising the maintenance sled 200, transport mechanism and maintenance modules. The ink delivery system 502 may be of the type described in U.S. Pat. No. 8,485,619, the contents of which are incorporated herein by reference. For example, the ink delivery system 502 may be a circulatory system having an ink container, which delivers ink to inlet ports 105 of the printhead cartridge 102 and receives ink from outlet ports 107 of the printhead cartridge. Various printing, purging, pressure priming and depriming operations may be coordinated via a pump and valve arrangement of the ink delivery system, as described in U.S. Pat. No. 8,485,619. However, it will of course be appreciated that other ink delivery systems may be used, as known in the art. The controller 500 coordinates all maintenance and printing operations via suitable signal communication with the ink delivery system 502 and maintenance system 504, as well as the print bar system 503 and media feed mechanism 501.

Lift Mechanism

Figure 5:
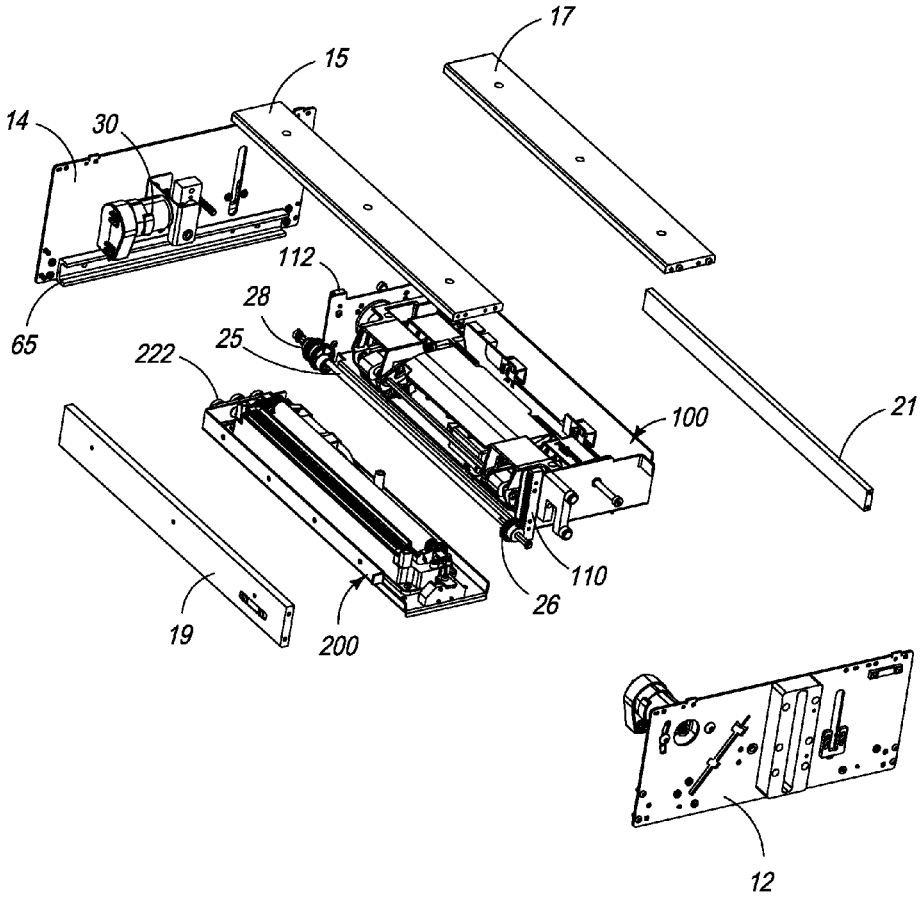
FIG. 5 is an exploded perspective of the printer module.
Figure 9:
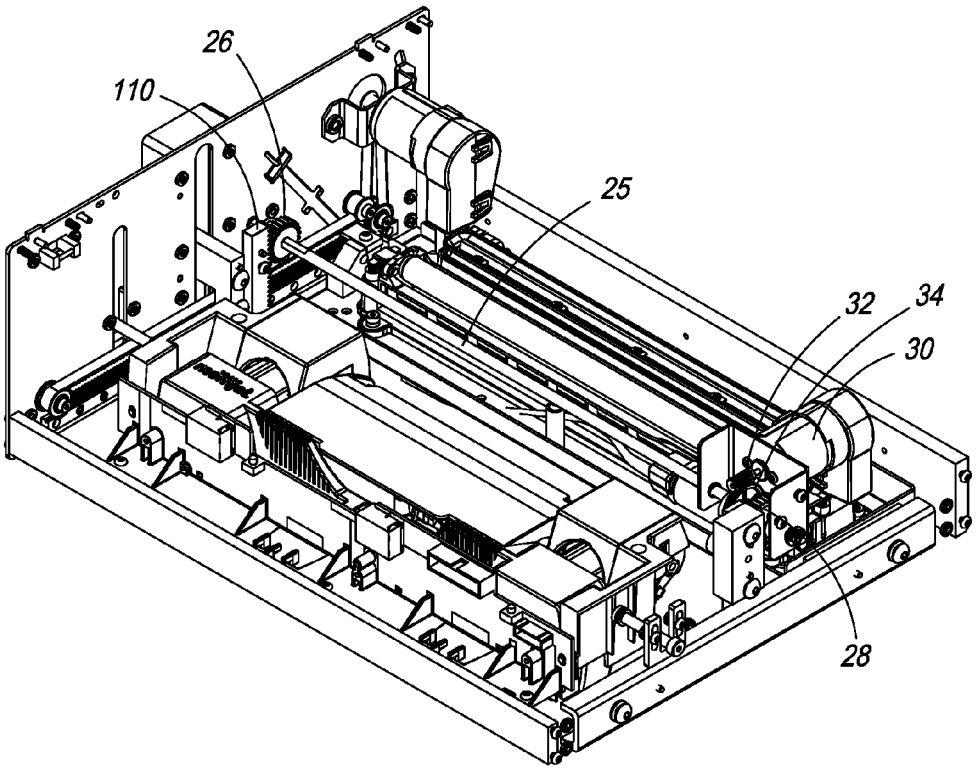
FIG. 9 is a perspective of the printer module in a printing position with mounting beams, a housing sidewall and print bar chassis side panels removed.

The print bar carriage 100 is slidably liftable relative to the housing 10 (along a nominal z-axis) using a rack-and-pinion lift mechanism. Referring initially to FIG. 7, the rack-and-pinion lift mechanism comprises first and second toothed racks 110 and 112 fixedly mounted to respective first and second side panels 114 and 116 of the chassis 104. The chassis 104 further comprises an end panel 118 and a base panel 120 interconnecting the side panels 114 and 116 to provide a rigid framework which ensures parallelism of the side panels and, therefore, parallelism of the racks 110 and 112 mounted to the side panels. As best shown in FIGS. 3, 5 and 9, a shaft 25 is rotatably mounted between the sidewalls 12 and 14 of the housing 10. First and second toothed pinions 26 and 28 are fixedly mounted about the shaft 25 at opposite ends thereof for rotation with the shaft. The first and second pinions 26 and 28 are intermeshed with respective first and second racks 110 and 112 to provide the rack-and-pinion lift mechanism.

Rotation of the shaft 25 is driven by a lift motor 30, which is engaged with the shaft via a worm gear arrangement. The worm gear arrangement comprises a worm 32 connected to the lift motor 30 and an intermeshing worm wheel 34 mounted about the shaft 25 adjacent the second pinion 28 (FIG. 9). Hence, the lift motor 30 is used to rotate the 25 shaft in either direction to perform either lifting or lowering of the print bar carriage 100 via the rack-and-pinion lift mechanism.

Constraint of Print Bar Carriage Movement

Figure 10:
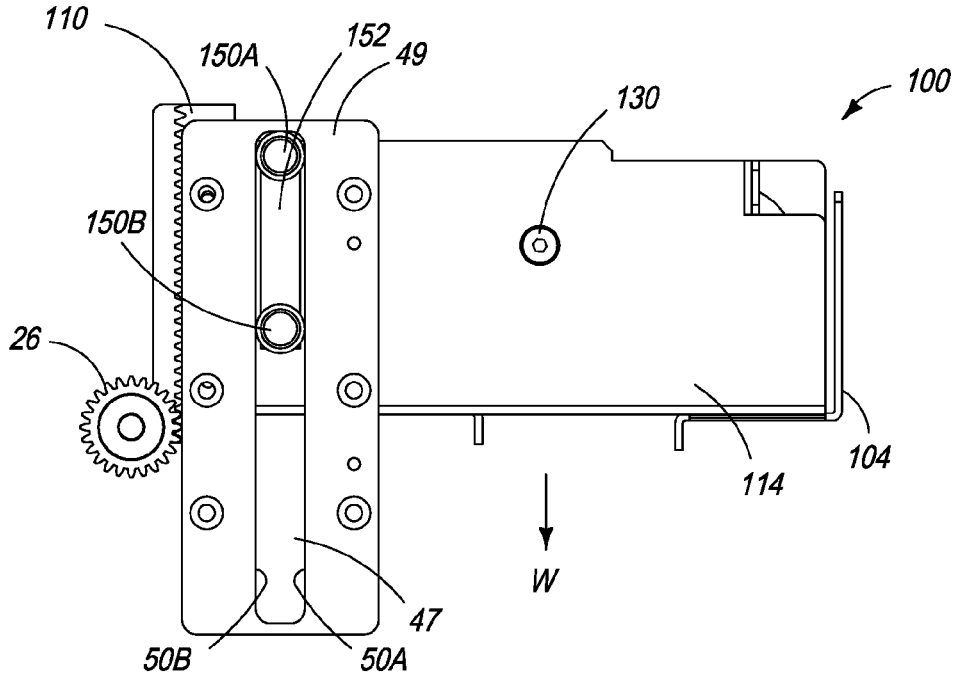
FIG. 10 is a side view showing engagement of a guide slot with first bearings in a raised position.

As described above, the print bar carriage 100 is lifted and lowered by actuation of the lift motor 30 operatively connected to the rack-and-pinion lift mechanism. In order to provide a smooth and reliable lift mechanism, it is preferable to constrain any rotational movement of the print bar carriage about the y-axis of the printer module 1. As viewed in FIG. 10, the print bar carriage 100 experiences a clockwise rotational biasing force about the pinion 26 due to the weight of the print bar carriage 100 indicated by arrow W.

In order to constrain any rotational movement, a pair of first bearings 150A and 150B are rotatably mounted to the first side panel 114 of the chassis 104 via a mounting bracket 152. The first bearings 150A and 150B are received in a guide slot 47 defined by the first sidewall 12 of the housing 10 and a guide bracket 49 fixed to an outer surface of the first sidewall 12. The guide slot 47 extends along the z-axis of the printer module 1 and is laterally displaced from a referencing slot 40 (described below) extending parallel therewith.

The guide bracket 49 defines a pair of opposite first bearing surfaces 50A and 50B extending along opposite longitudinal sides of the guide slot 47. The first bearing surfaces 50A and 50B provide a reaction force to the intrinsic rotational bias of the print bar carriage 100. The first bearings 150A and 150B, aligned parallel with the guide slot 47, travel within the guide slot along the z-axis and bear against respective bearing surfaces 50A and 50B during lifting and lowering of the print bar carriage 100. In practice, a marginal degree of clearance (e.g. 0.01 to 0.1 mm) between the first bearings and the first bearing surfaces allows the upper first bearing 150A to bear against the right-hand first bearing surface 50A and the lower first bearing 150B to bear against the left-hand first bearing surface 50B (as viewed in FIG. 10) with the rotational bias of the print bar carriage 100.

Figure 11:
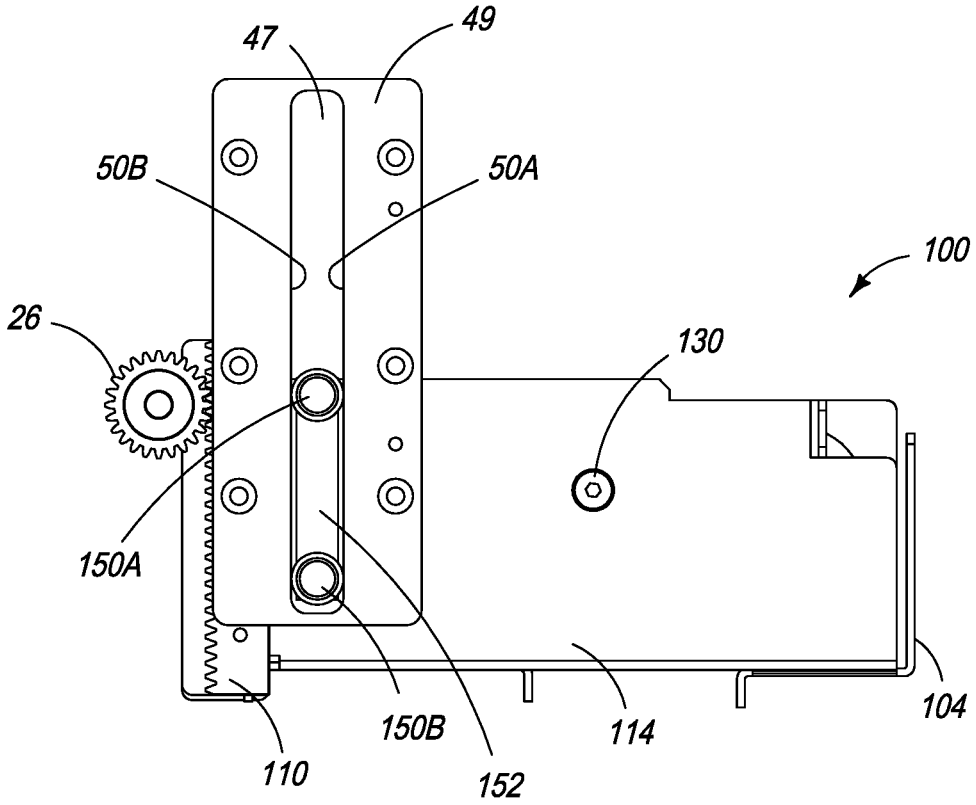
FIG. 11 is a side view showing engagement of a guide slot with first bearings in a printing position.

FIG. 11 is a side view of the first bearings 150 and guide slot 47 when the print bar carriage 100 is in its lowermost printing position. With the print bar carriage 100 supported by the first stops 36 in this lowermost position, the rotational bias of the print bar carriage is reversed.

Figure 12:
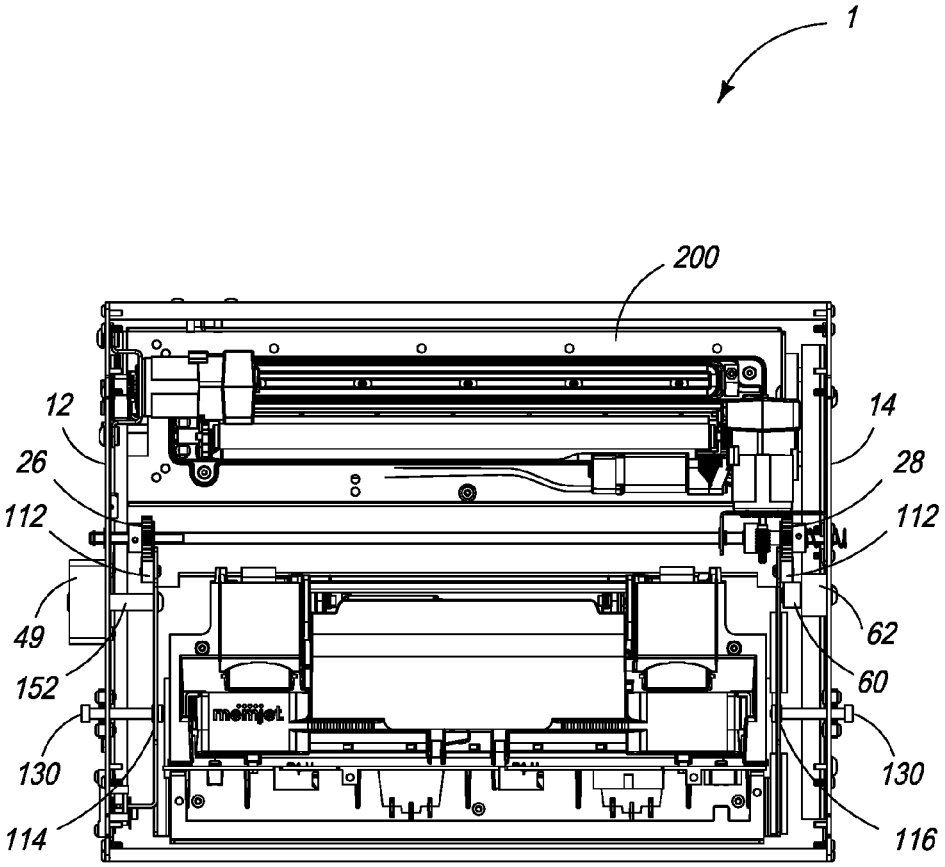
FIG. 12 is a top plan view of the printer module with mounting beams removed.
Figure 13:
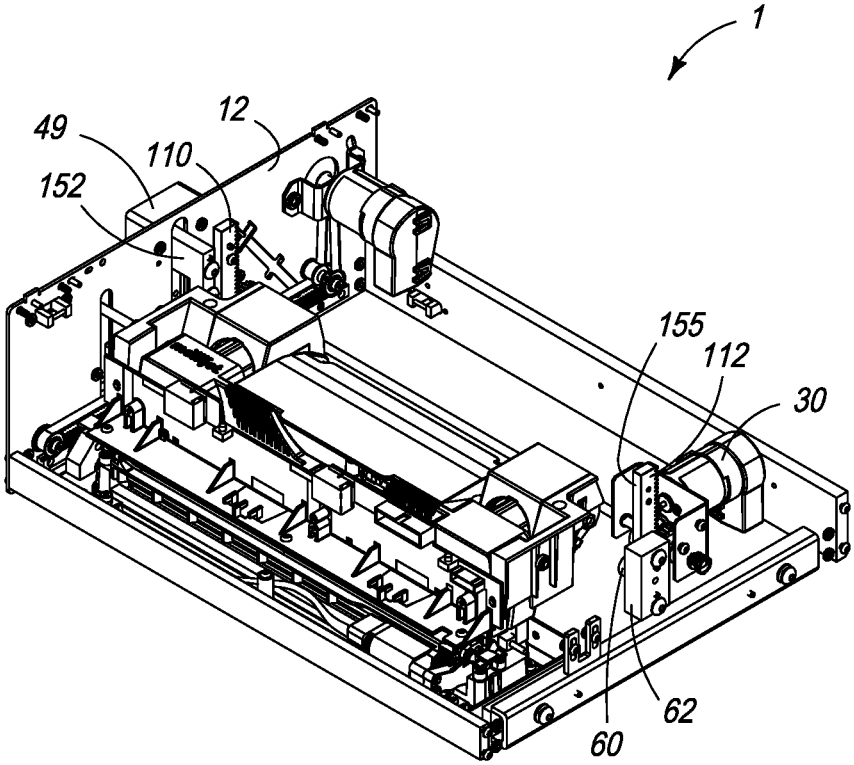
FIG. 13 is a perspective of the printer module in a maintenance position with mounting beams, a housing sidewall and print bar chassis side panels removed.

Referring to FIGS. 12 and 13, a second bearing 60 is rotatably mounted to an inner surface of the second sidewall 14 of the housing 10 via a mounting block 62. The second bearing 60 is positioned to bear against a non-toothed surface of the second rack 112. The non-toothed surface is opposite the toothed surface of the second rack 112 and defines a second bearing surface 155 for the second bearing 60 to bear against during lifting and lowering of the print bar carriage 100. FIG. 13 has the second sidewall 14 and second side panel 116 removed to show the engagement of the second bearing 60 with the second bearing surface 155 more clearly.

The first bearings 150 and the second bearing 60 cooperate with their respective first bearing surfaces 50 and second bearing surface 155 to constrain rotational movement of the print bar carriage 100 about the y- and z-axes (theta y and theta z) during lifting and lowering. This constraint of rotational movement minimizes any undue wearing of the rack-and-pinion mechanism upon repeated lifting and lowering of the print bar carriage 100.

Datum Arrangements

Referring to FIGS. 1 to 4, the printing position of the print bar carriage 100 is defined by a pair of first stops 36 mounted to the outer surfaces of the first and second sidewalls 12 and 14. Each of the first stops 36 is positioned towards a lower end of respective referencing slots 40 defined in respective sidewalls 12 and 14 of the housing 10. The chassis 104 has a pair of lugs 130 extending outwardly from respective side panels 114 and 116, and the lugs are received in respective referencing slots 40 of the housing 10. The lugs 130 are slidably movable along the z-axis within their respective referencing slots 40. The first stops 36 define respective first datum surfaces 37 for abutting engagement with respective lugs 130 in the printing position (FIG. 3). When each of the lugs 130 has been lowered into abutting engagement with its respective abutment surface 37, the print bar carriage 100 is in its printing position.

During lifting and lowering, the print bar carriage 100 may bow in the z-axis, causing one of the lugs to engage with its respective abutment surface before the other lug. In order to accommodate potential bowing of the print bar carriage 100, the controller 500 receives feedback from the lift motor 30—when the lift motor experiences a sharp increase in resistance, corresponding to one of the lugs engaging with its respective abutment surface, the controller instructs the motor to continue for a predetermined period to ensure that the other lugs also engages with its respective abutment surface. In this way, seating of the print bar carriage 100 in its printing position is ensured with each lowering operation.

The first stops 36 are each slidably mounted to respective sidewalls 12 and 14 to provide adjustable printing positions. Accordingly, after installation of the printer module 1, users are able to adjust the printing position of the printhead in order to optimize print quality, for example, when printing onto different media thicknesses. Each of the stops 36 is secured into position, after sliding adjustment of the stop, via a respective pair of locking screws 45.

The printing position of the print bar carriage 100 is critical for controlling the throw distance of ejected ink droplets (otherwise known in the art as the "pen-to-paper spacing" (PPS)) and, as described above, the first datum surfaces 37 provide accurate control of this distance in combination with the lugs 130 attached to the chassis 104.

Since the capper module 202 typically comprises an internal wick element (not shown), which should be positioned in close proximity to but not touching the printhead 105 during capping (see US2011/0279524, the contents of which are incorporated herein by reference), it is important to control the printhead-capper distance when the print bar carriage 100 is positioned in the capping position.

Figure 14:
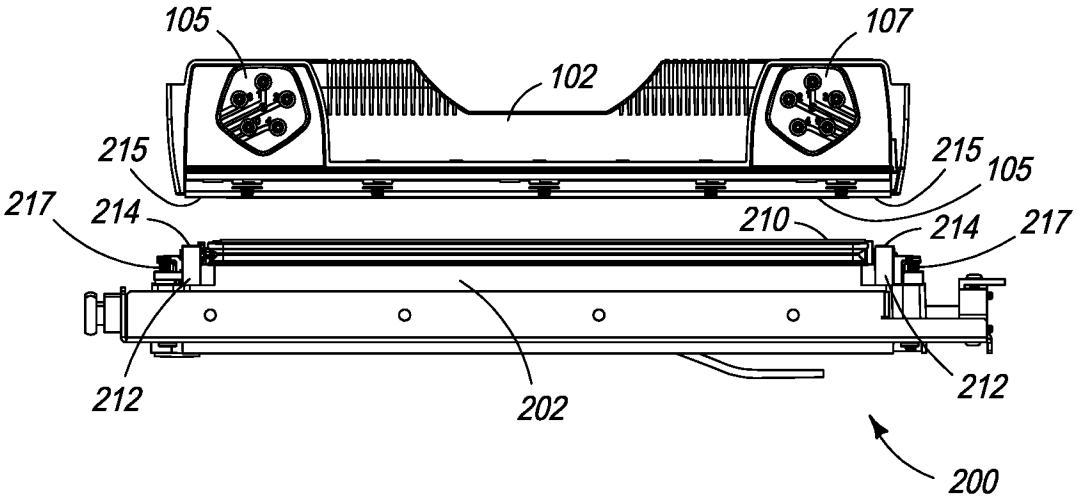
FIG. 14 is a rear view of a printhead cartridge and maintenance sled.

Referring to FIG. 14, the capper module 202 comprises a perimeter capper 210, extending a length of the printhead 105, having resiliently deformable sidewalls defining an internal cavity. The capper module 202 further comprises a pair of seconds stops 212 positioned at either end of the perimeter capper 210. The second stops 212 define respective second datum surfaces 214 for abutting engagement with respective landing zones 215 defined by the printhead cartridge 102 at either end of the printhead 105. When the print bar carriage 100 is lowered into the capping position (FIG. 4), the landing zones 215 abut with the second datum surfaces 214 to define the capping position.

Hence, the printing position of the print bar carriage 100 is controlled by abutting engagement of the lugs 130 with the first datum surfaces 37; and the capping position of the print bar carriage 100 is controlled by abutting engagement of the landing zones 215 with the second datum surfaces 214.

Maintenance Sled and Transport Mechanism

Figure 15:
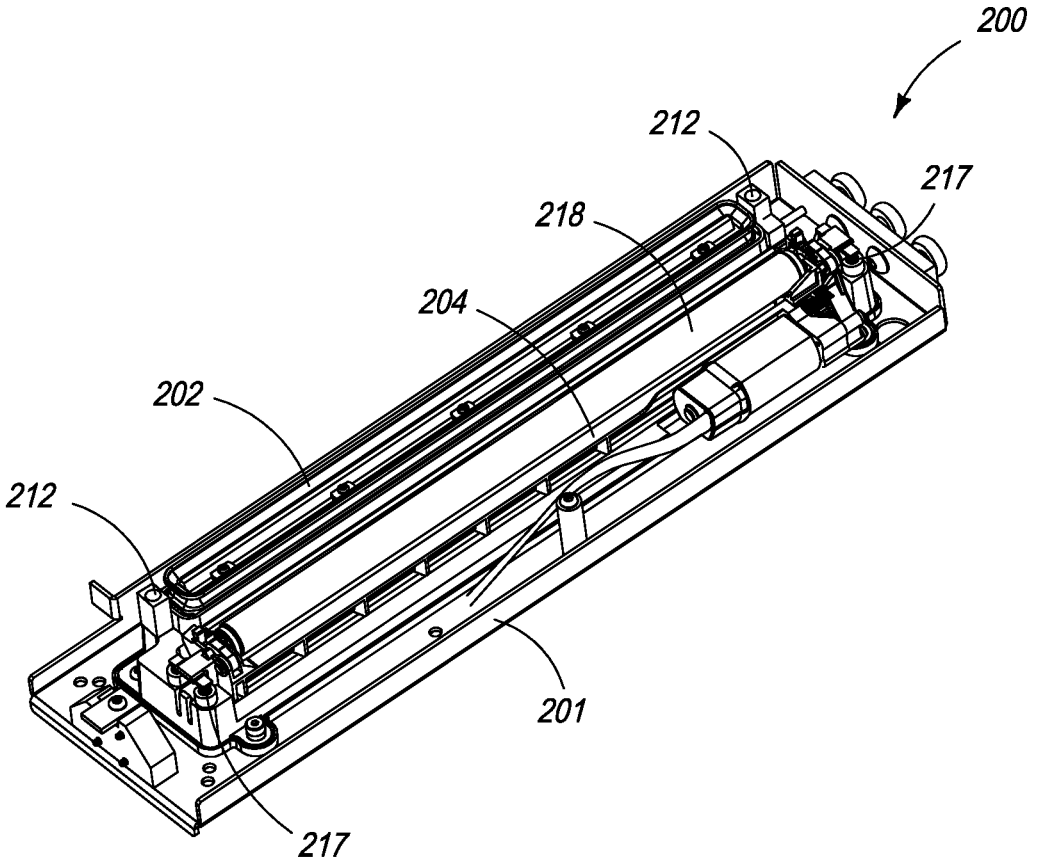
FIG. 15 is a perspective of the maintenance sled.

As described above in connection with FIGS. 1 to 4, the maintenance sled 200 is slidable towards and away from the printhead 105 in a direction parallel with the media feed direction. Referring to FIG. 15, the maintenance sled comprise a sled frame 201 on which is mounted the capper module 202 and the wiper module 204 (collectively known herein as "maintenance modules").

As described above the capper module 202 is fixedly mounted to the sled frame 201, while the wiper module 204 is resiliently mounted to the sled frame via coil springs 217, which bias the wiper module towards the printhead 105 during wiping operations. The wiper module 204 comprises a wiper roller 218 having a microfiber surface, which is configured to wipe ink and debris from the printhead 105 when rotated or translated in contact therewith. A metal transfer roller (not shown in FIG. 15) is in permanent contact with the microfiber wiper roller 218 to receive ink carrying entrained debris from the wiper roller. For a more detailed description of the wiper module, reference is made to US 2012/0092419, the contents of which are incorporated herein by reference.

The distance between the wiper roller 218 and the printhead 105 during wiping is less critical than the capping distance. Accordingly, the biasing of the wiper module 204 via the springs 217 is sufficient to provide a suitable wiping force without accurate control of the printhead position during wiping operations.

The maintenance sled 200 is slidably mounted between the sidewalls 12 and 14 of the housing 10 to enable sliding movement along the x-axis of the printer module 1. Referring briefly to FIG. 5, a sled guide 65 is fixedly mounted to an inner surface of the second sidewall 14 and extends along the x-axis. The sled guide 65 receives a set of sled bearings 222 rotatably mounted to a second side of the sled frame 291.

Figure 16:
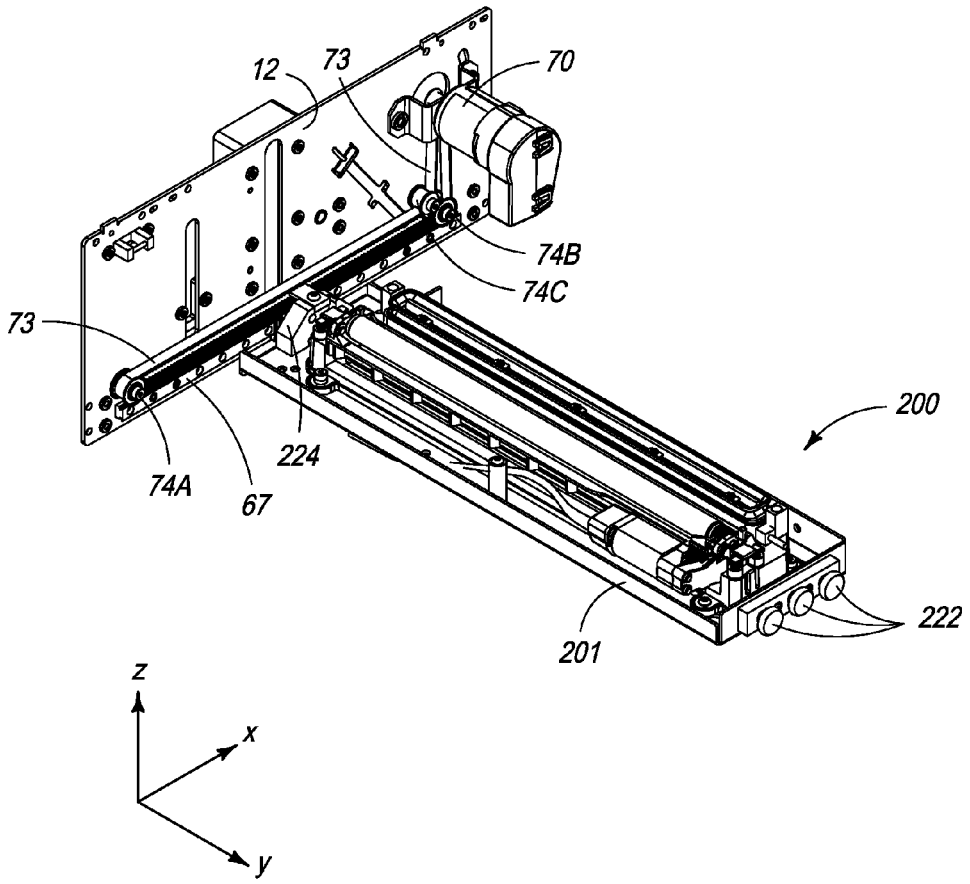
FIG. 16 is a perspective of the maintenance sled and transport mechanism.
Figure 17:
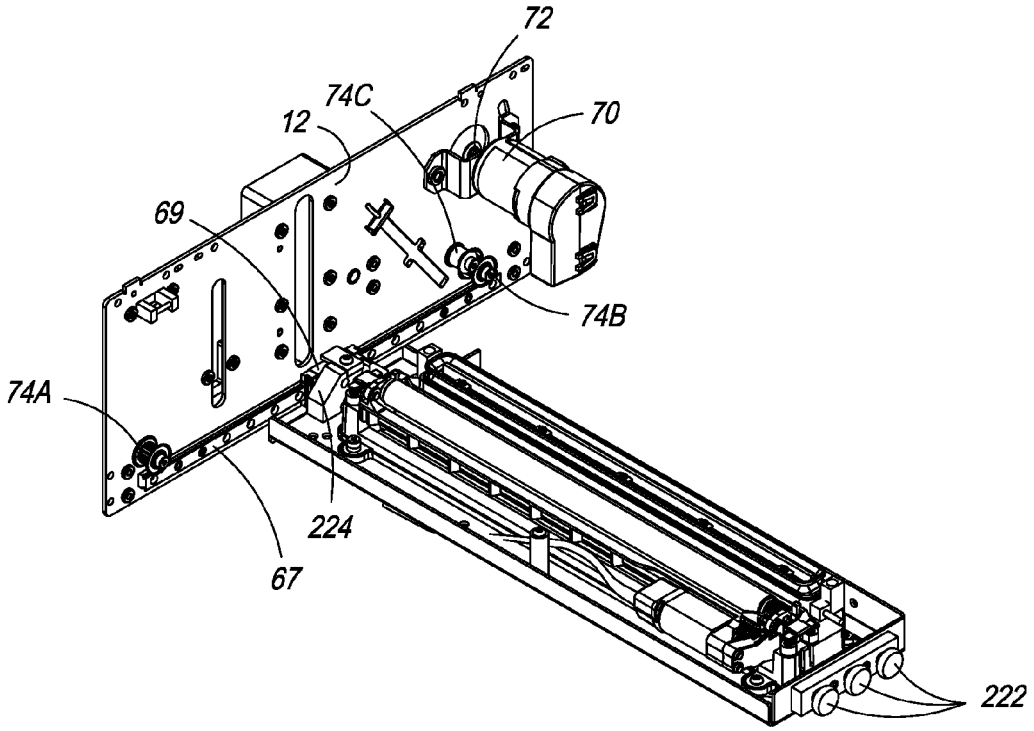
FIG. 17 is a perspective of the maintenance sled and transport mechanism with drive belt removed.

Turning to FIGS. 16 and 17, a rail 67 is fixedly mounted to an inner surface of the first sidewall 12 and extends along the x-axis. A sled carriage 69 is slidably mounted on the rail 67 for movement therealong. The sled carriage 69 is connected to a sled mount 224 fixed to the sled frame 201. Hence, the maintenance sled 200 is slidable along a track defined by the sled guide 65 and the rail 67.

Movement of the sled carriage 69 along the rail 67 is driven by a transport mechanism comprised of a transport motor 70 operatively connected to a drive pulley 72, and an endless drive belt 73 tensioned between the drive pulley 72 and idler pulleys 74A, 74B and 74C. A first idler pulley 74A is mounted to the first sidewall 12 at one end of the rail 67, while second and third idler pulleys 74B and 74C are mounted to the first sidewall 12 at the other end of the rail 67. The idler pulleys 74A, 74B and 74C serve to steer the drive belt 73 between the two ends of the rail 67 and around the drive pulley 72.

As shown in FIG. 16, the drive belt 73 has a toothed inner surface engaged with the sled mount 224. Thus, movement of the drive belt 73, driven by the transport motor 70, causes the maintenance sled 200 to move along the x-axis of the printer module 1, either towards or away from the print bar carriage 100.

Modular Printer Comprising Array of Printer Modules

Figure 18:
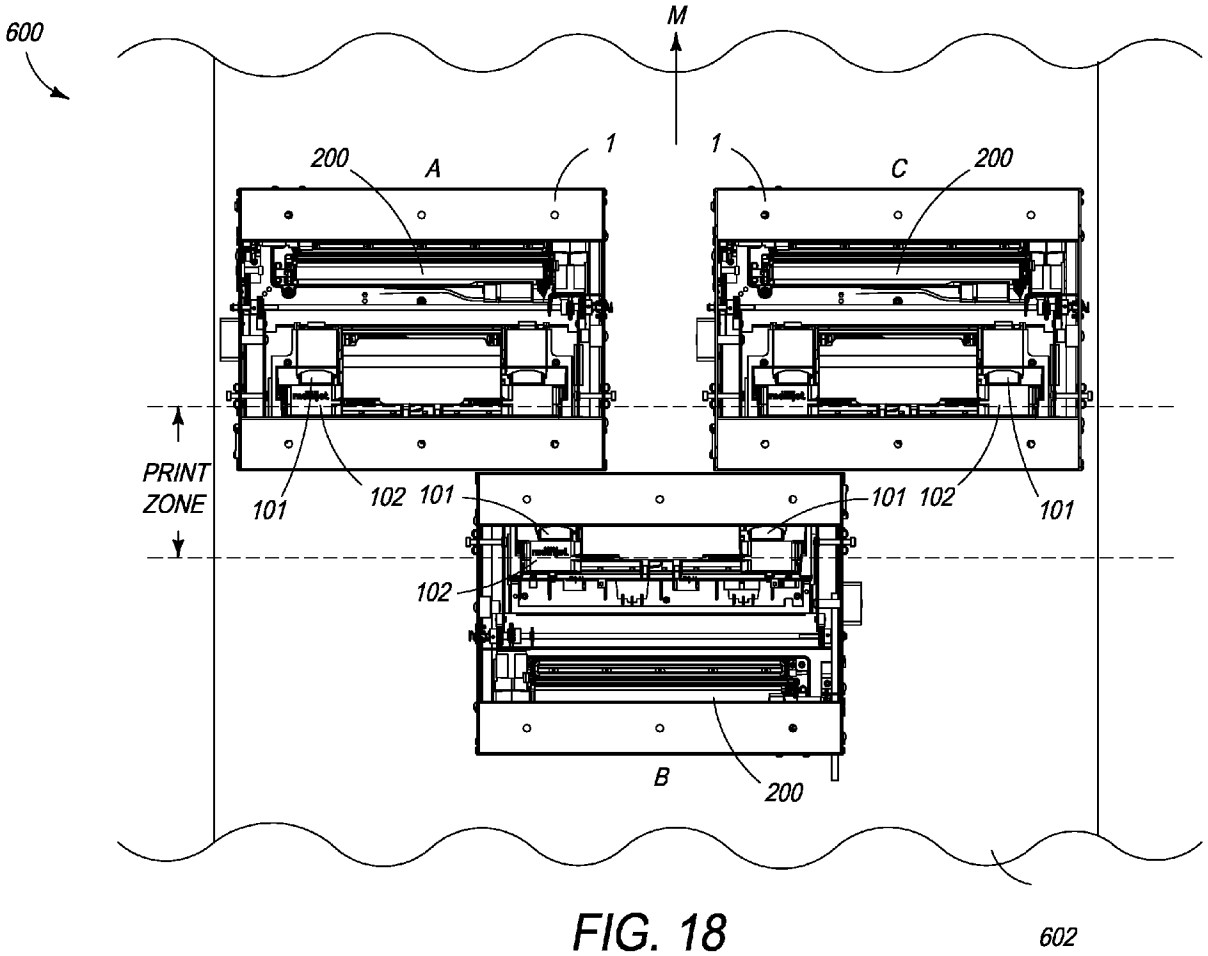
FIG. 18 is a top plan view of a modular printer according to the present invention.

Referring to FIG. 18, and having described the printer module 1 in detail, there is shown in plan view a modular printer 600 comprising three printer modules A, B and C arranged in a staggered overlapping array. The printer modules A, B and C are mounted to a gantry (not shown) extending over a media web 602 so that each printer module is suspended over the web. The media feed direction is indicated by the arrow M. With this staggered overlapping arrangement, it is possible to print onto relatively wide media widths; in principle, the modular printer 600 may comprise any number of printer modules from, for example, 2 to 10 modules.

Each printer module overlaps with at least one neighboring printer module in the media feed direction M With suitable timing and control of nozzle firing in each printer module, an image may be printed seamlessly onto the web 602 using each of the overlapping modules. An analogous arrangement of staggered overlapping printheads, albeit with a different maintenance arrangement, was described in U.S. Pat. No. 8,485,656, the contents of which are incorporated herein by reference.

In the modular arrangement shown in FIG. 18, the printer modules A, B and C are oriented such that the printhead cartridges 102 are relatively proximal to each other and the maintenance sleds 200 relatively distal from each other with respect to the media feed direction. In other words, the middle printer module B has it orientation reversed compared to the two outer printer modules A and C. This arrangement positions the printheads 105 in relatively close proximity and, therefore, minimizes the width of the print zone. (As used herein, the width of the print zone is defined parallel with the media feed direction, while the length of the print zone is defined perpendicular to the media feed direction). Thus, in order to perform maintenance on all printer modules simultaneously, the maintenance sled 200 of printer module B moves in an opposite direction to the maintenance sleds 200 of printer modules A and C. In other words, all maintenance sleds 200 move towards the print zone in order to perform maintenance operations on their respective printheads 105. This arrangement of printer modules enables high print quality by minimizing the width of the print zone and, furthermore, enables printhead maintenance without breaking the media web 602.

Still referring to FIG. 18, it should be noted that printer module B is similar, but not identical to printer modules A and C. Printer modules A and C are identical to the printer module 1 described above and has the ink manifold 101 relatively proximal to the maintenance sled 200 in the printing position, as shown. However, printer module B is subtly different than printer modules A and C inasmuch as the ink manifold 101 of printer module B is relatively distal from the maintenance sled 200 in the printing position, as shown. This subtle difference enables all printhead cartridges 102, and thereby all printheads 105, to be oriented identically with respect to the media feed direction M.

Accordingly, all printheads 105, having a predetermined order of color channels, print in the same directional sense and the same firing order of color channels. Therefore, any print artifacts arising from overprinting or underprinting during multi-color printing are minimized.

It will, of course, be appreciated that the present invention has been described by way of example only and that modifications of detail may be made within the scope of the invention, which is defined in the accompanying claims.

The invention claimed is:

1. A method of wiping a plurality of printheads positioned in a staggered overlapping arrangement across a width of a media feed path, each printhead having a respective wiper associated therewith, wherein:

the wipers for neighboring printheads are moved in opposite directions with respect to each other;

each wiper is mounted on a respective maintenance module; and each maintenance module further comprises a capper for capping a respective printhead.

2. The method of claim 1, comprising the step of:

lifting the printheads from a printing position to a maintenance position prior to moving the wipers.

3. The method of claim 1, wherein a print zone of the printer has a width in the range of 10 to 100 mm, the width of the print zone being defined in a direction parallel to the media feed direction.

4. The method of claim 3, wherein the print zone has a length greater than 216 mm, the length of the print zone being defined in a direction transverse to the media feed direction.

5. A modular printer comprising:

a media feed path defining a media feed direction;

a plurality of printheads positioned in a staggered overlapping arrangement so as to extend across a width of the media feed path;

a plurality of wipers for wiping the plurality of printheads, each printhead having a respective wiper associated therewith wherein:

the wipers for neighboring printheads are configured to move in opposite directions relative to each other during wiping;

each wiper is mounted on a respective maintenance module; and each maintenance module further comprises a capper for capping a respective printhead.

6. The modular printer of claim 5, wherein each printhead comprises a replaceable printhead cartridge.

7. The modular printer of claim 6, wherein the printhead cartridges are all identical.

8. The modular printer of claim 7, wherein the printhead cartridges are asymmetric and oriented identically with respect to the media feed direction.

9. The modular printer of claim 5, wherein a print zone of the printer has a width in the range of 10 to 100 mm, the width of the print zone being defined in a direction parallel to the media feed direction.

10. The modular printer of claim 5, wherein the print zone has a length greater than 216 mm, the length of the print zone being defined in a direction transverse to the media feed direction.

* * * * *